US009476613B2

(12) United States Patent
Tepas et al.

(10) Patent No.: US 9,476,613 B2
(45) Date of Patent: Oct. 25, 2016

(54) METHOD TO CONTROL A COOLING CIRCUIT

(71) Applicant: MAHLE International GmbH, Stuttgart (DE)

(72) Inventors: John Milton Tepas, Ann Arbor, MI (US); Lawrence Wei, Berkley, MI (US)

(73) Assignee: MAHLE International GmbH, Stuttgart (DE)

( * ) Notice: Subject to any disclaimer, the term of this patent is extended or adjusted under 35 U.S.C. 154(b) by 207 days.

(21) Appl. No.: 14/250,051

(22) Filed: Apr. 10, 2014

(65) Prior Publication Data

US 2015/0292776 A1 Oct. 15, 2015

(51) Int. Cl.
*F25B 5/00* (2006.01)
*F25B 5/02* (2006.01)

(52) U.S. Cl.
CPC ..... *F25B 5/02* (2013.01); *F25B 2600/2511* (2013.01)

(58) Field of Classification Search
CPC ..... F25B 31/04; F25B 2400/13; F25B 1/10; F25B 13/00; F25B 39/02
USPC ..... 62/117, 119, 335, 498, 515
See application file for complete search history.

(56) References Cited

U.S. PATENT DOCUMENTS

| | | | | |
|---|---|---|---|---|
| 5,092,138 | A * | 3/1992 | Radermacher | F25B 5/04 62/114 |
| 5,235,820 | A * | 8/1993 | Radermacher | F25B 1/10 62/114 |
| 5,243,837 | A * | 9/1993 | Radermacher | F25B 5/04 62/113 |
| 7,257,965 | B2 * | 8/2007 | Meister | F25B 5/04 62/513 |
| 7,624,585 | B2 * | 12/2009 | Yuzawa | C09K 5/045 62/114 |
| 2006/0090505 | A1 * | 5/2006 | Lifson | F25B 5/00 62/510 |
| 2009/0314023 | A1 * | 12/2009 | Labaste Mauhe | B60H 1/005 62/335 |
| 2011/0000241 | A1 | 1/2011 | Favaretto | |

* cited by examiner

*Primary Examiner* — Melvin Jones
(74) *Attorney, Agent, or Firm* — Muncy, Geissler, Olds & Lowe, P.C.

(57) ABSTRACT

A method to control a cooling circuit, with the cooling circuit comprising at least three evaporators, which are fluid connected to the cooling circuit in a parallel connection in individual paths, with each of the paths containing one shut-off valve, through which the flow of the refrigerant, which is circulating through the specific path, can be metered or cut off, where the shut-off valves can be activated or deactivated individually, with the individual evaporators being operative when the shut-off valve located within the specific path of the individual evaporator permits fluid flow, where a maximum of two of the at least three evaporators are operative simultaneously.

13 Claims, 2 Drawing Sheets

METHOD TO CONTROL A COOLING CIRCUIT

BACKGROUND OF THE INVENTION

1. Field of the Invention

The present invention relates to a method to control a cooling circuit, with the cooling circuit comprising at least three evaporators, which are fluid connected to the cooling circuit in a parallel connection in individual paths, with each of the paths containing one shut-off valve, through which the flow of the refrigerant, which is circulating through the specific path, can be metered or cut off, where the shut-off valves can be activated or deactivated individually, with the individual evaporators being operative when the shut-off valve located within the specific path of the individual evaporator permits fluid flow.

2. Description of the Background Art

Modern automobile vehicles usually feature a first evaporator, which can be used for cooling purposes for the front passengers, and a second evaporator, which can be used for cooling purposes for the rear passengers. The evaporators are fluid connected to a fluid circuit, in which a refrigerant fluid circulates. Furthermore this fluid circuit usually features a compressor to compress the refrigerant fluid. The evaporators can be arranged in a parallel connection or in a series connection.

In some vehicles, especially in electric-vehicles or hybrid-vehicles, the need for additional cooling loads came up in the past. The additional cooling loads are mainly needed for the electric components e.g. the traction batteries or other power electronics. Batteries usually have to be kept at a certain temperature level to maintain a high performance level. Therefore it might be necessary to heat the battery or even more important to cool down the battery.

US patent application US 2011/0000241 A1 features three evaporators that are connected to one or more cooling circuits.

However the solutions known in the conventional art have certain disadvantages. One of these disadvantages is the need for more complex control systems to regulate the flow of the refrigerant within the cooling circuits. Furthermore it is disadvantageous that the compressor of the cooling circuit needs to be adapted to the higher refrigerant volume within the cooling circuit and to the higher compression load, which comes along with the higher refrigerant volume.

SUMMARY OF THE INVENTION

It is therefore an object of the present invention to provide a method to control a cooling circuit with at least three independent evaporators. Furthermore it is an object of the invention to provide a cooling circuit with three evaporators, which has improved capabilities regarding the storage of thermal energy.

According to an embodiment of the invention a method to control a cooling circuit is provided, with the cooling circuit comprising at least three evaporators, which are fluid connected to the cooling circuit in a parallel connection in individual paths, with each of the paths containing one shut-off valve, through which the flow of the refrigerant, which is circulating through the specific path, can be metered or cut off, where the shut-off valves can be activated or deactivated individually, with the individual evaporators being operative when the shut-off valve located within the specific path of the individual evaporator permits fluid flow, where a maximum of two of the at least three evaporators are operative simultaneously.

Activation of a shut-off valve means opening it to allow a fluid flow through it, hence deactivation means closing the shut-off valve to meter the fluid flow or cut it off. The cooling circuit comprises one compressor, which is fluid connected to all paths of the cooling circuit. A maximum of two evaporators are operative at the same time, which is advantageous as the compressor can be the same as in commonly known cooling circuits with just two evaporators. This applies especially to the compressor capacity. The cooling circuit thus acts always as a cooling circuit with just two evaporators.

According to an embodiment of the invention, the activation and/or deactivation of the shut-off valves is based on a prioritization of the cooling needs of specific components.

The cooling need can originate from the battery of an automobile vehicle. The cooling need can also originate from the air conditioning system e.g. to maintain a certain temperature level within the cabin of an automobile vehicle. A prioritization thus can mean, that the cooling need of the battery can be prioritized over the cooling need of the cabin. This is advantageous as the overall capacity of the cooling circuit can be split up to the individual evaporators based on the current needs of the components.

In a further embodiment, the activation and/or deactivation of the shut-off valves is based on preset limits regarding temperature levels and/or preset boundaries regarding temperature gradients.

Such preset limits can be minimum or maximum temperatures e.g. of the battery or the air within the cabin. Alternatively the limits can result from temperature gradients, where a maximum permissible gradient is defined. This is advantageous as for instance very fast or very slow changes of the temperature can be avoided. This is especially advantageous for the battery as it is sensitive to temperature changes. Also the lifetime of a battery can be reduced noticeably by frequent drastic temperature changes.

In an embodiment, it is preferable, if the activation and/or deactivation of the shut-off valves is triggered by one or more preset routines, which are integrated as default values within the control system.

The cooling circuit can be controlled by a control device. The activation and the deactivation of the shut-off valves can be controlled through such a device. The control device can comprise a processing unit, which allows to store preset routines. These routines can be adapted to certain scenarios, which may occur while the usages of the cooling circuit. This is advantageous as the cooling circuit can adequately be controlled through preset routines without the need for time-consuming computations.

Furthermore it is functional, if a preset routine triggers the activation of a shut-off valve based on the distribution of a lubricant within the cooling circuit.

Especially, a distribution of the lubricant within the cooling circuit is important, as it is imperative that the compressor is always supplied with enough lubricant to avoid damage. As at least one path is deactivated at all times, it is possible that the lubricant is distributed unequally within the cooling circuit. This can lead to an insufficient supply of lubricant to the compressor, which may lead to a damage of the compressor. Therefor it is advantageous if the distribution of the lubricant can be measured or calculated at all times to ensure a sufficient supply of lubricant for all lubricant-sensitive components in the cooling circuit. If the concentration of lubricant in a temporarily deactivated path is increased and hence the concentration in the rest of the cooling circuit is decreased, it is possible to activate the specific path to ensure a transport of the lubricant into the rest of the cooling circuit. This activation can even last only a few seconds.

Furthermore it is beneficial, if a preset routine triggers the activation of a shut-off valve after a predetermined time has elapsed since the last activation. This is advantageous as sediments within the deactivated paths can be avoided. It is also beneficial, as a phase separation of the refrigerant in the cooling circuit due to the lack of fluid movement can be avoided.

Besides this it is preferable, if a preset routine triggers the activation and/or deactivation of a shut-off valve based on a prediction of future cooling loads. The prediction of future cooling loads can be based on the cooling demand of the passengers, which is expressed by the adjustment of the air conditioning unit. Alternatively the prediction can be based on temperatures e.g. of the battery, which can be measured and evaluated. Furthermore it is possible to take multifaceted information as e.g. the ambient temperature, the number of passengers, the altitude of the sun or other influences, which can be relevant to the prediction of future cooling loads, into account for the prediction.

Furthermore it is beneficial, if one or more of the evaporators is a storage evaporator, which possesses the capability to store cooling capacity. A storage evaporator is advantageous as it has the ability to store cooling capacity by freezing a latent medium. The freezing of the latent medium can thereby be achieved in moments where not all of the available cooling capacity of the cooling circuit is needed, thus the freezing can be achieved by otherwise unused energy. The storage evaporator is beneficial, as the stored cooling capacity can be used in times, where the cooling circuit is not operative or when a higher cooling demand arises. Especially for hybrid vehicles or electric vehicles this is advantageous, as cooling can be achieved without the need to operate the compressor.

In an alternative embodiment it is preferable, if the cooling circuit comprises one compressor, three evaporators, three shut-off valves, one condenser and one or more expansion devices, where either each path comprises one expansion device or two or more paths share one expansion device. Depending on the layout of the cooling circuit it can be advantageous to use one expansion device for two or more paths of the cooling circuit. By using an expansion device for two or more paths the required number of expansion devices can be reduced, which is beneficial for the costs of the system.

Besides this it is preferable, if the cooling circuit is implemented within an automobile vehicle, with the shut-off valves are being activated and/or deactivated based on information of sensors of the automobile vehicle.

This is beneficial as more information can be gathered to find a suitable operation mode for the cooling circuit. Especially GPS-signals of the vehicle and possibly information about the planned route can be advantageous to activate or deactivate the evaporators to achieve a satisfying cooling. For instance if the GPS sees a long uphill climb ahead and thus it is foreseeable that the cooling need of the battery will increase due to higher power output of the battery the evaporators can be activated accordingly to ensure a sufficient cooling of the battery. If a storage evaporator is used the fluid flow through the storage evaporator can be increased to ensure that the latent medium is fully frozen and hence that the maximum of cooling capacity is available.

In an alternative scenario where the system knows that the cooling need of e.g. the battery will increase while it also knows that there are passengers in the rear seats it can start increasing the flow through the evaporator, which cools down the rear seats before the increased cooling need of the battery actually arises. When the increased cooling need finally arises the evaporator for the rear seats can be switched off by deactivating the specific switch-off valve to ensure that the full cooling capacity is put on the evaporator that cools the battery. By using such information it is possible to split up the cooling capacity better and more accurate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
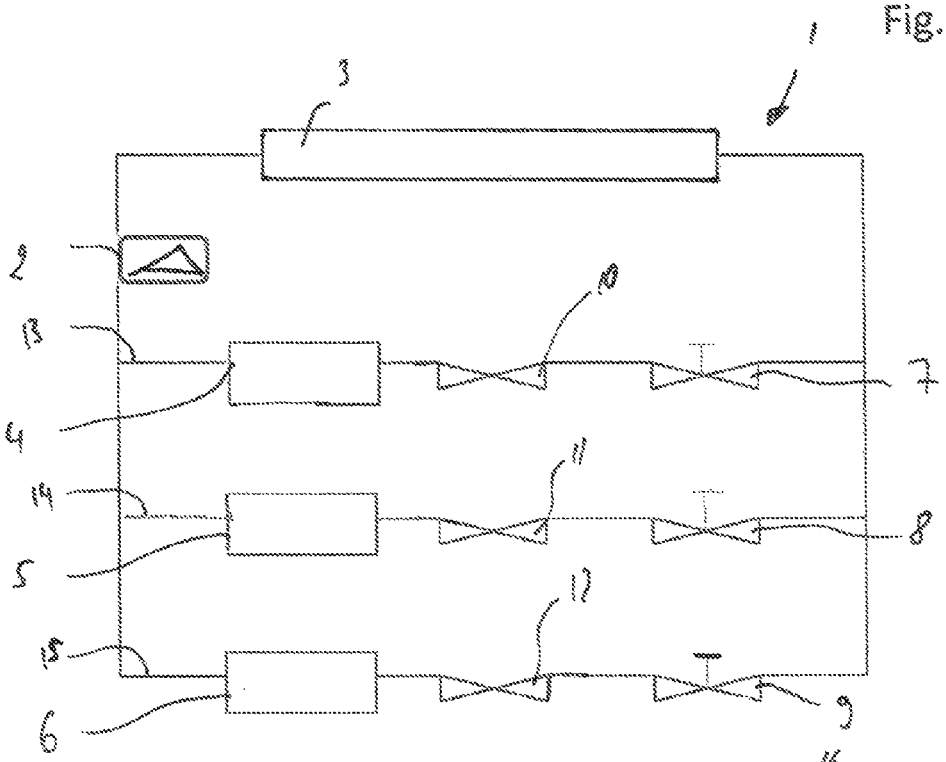
FIG. 1 shows a schematic of a cooling circuit according to an embodiment of the invention, where the cooling circuit comprises one compressor and one condenser, which are connected in a series connection, with three evaporators being arranged parallel to each other in three different paths, with respectively one expansion device in each path and respectively one shut-off valve in each path.

FIG. 1 shows a schematic cooling circuit 1. The cooling circuit 1 comprises a compressor 2, a condenser 3, three evaporators 4, 5 and 6, three expansion devices 10, 11 and 12 and three shut-off valves 7, 8 and 9. The compressor 2 and the condenser 3 are fluid connected to each other in a series connection. The cooling circuit 1 further comprises three individual paths 13, 14 and 15, which are arranged in a parallel connection within the cooling circuit 1.

Each path 13, 14 and 15 comprises one of the evaporators 4, 5 and 6, one of the expansion devices 10, 11 and 12 and one of the shut-off valves 7, 8 and 9. The first path 13 comprises the first evaporator 4, followed by the first expansion device 10 and the first shut-off valve 7. The second path 14 comprises the second evaporator 5, followed by the second expansion device 11 and the second shut-off valve 8. The third path 15 comprises the third evaporator 6, followed by the third expansion device 12 and the third shut-off valve 9.

The fluid flow through each path, 13, 14 and 15 and hence the fluid flow through the evaporators 4, 5 and 6 can be metered or cut off completely through the shut-off valves 7, 8 and 9. The shut-off valves 7, 8 and 9 can be activated by a solenoid or other switching mechanisms. They can either cut off the fluid flow completely or reduce the fluid flow to a certain desired amount.

Each of the evaporators 4, 5 and 6 is used for a specific cooling function within an automobile vehicle, in which the cooling circuit is installed. Among others the cooling functions could be cooling the front part of a cabin of, for example, a vehicle, cooling of the rear part of the cabin or cooling of electronic devices e.g. a battery. Depending on the cooling needs of these elements, the shut-off valves 7, 8 and 9 can be activated or deactivated individually.

At any time a maximum of two evaporators 4, 5 and 6 are operative, while the last evaporator 4, 5 or 6 is not operative. This is advantageous as only two evaporators 4, 5 or 6 need to be supplied with refrigerant through the compressor 2 at any time. Therefore the compressor 2 can be the same as in cooling circuits with only two evaporators in total. This is especially beneficial, as the compressor has not to be adapted to the higher demands of the cooling circuit 1 with three evaporators 4, 5 and 6.

In an exemplary embodiment one or more of the evaporators 4, 5 and 6 can be designed as a storage evaporator. Storage evaporators are beneficial as they have the ability to store cooling capacity by freezing over a latent medium, which is enclosed within the storage evaporator. The usage of storage evaporators is beneficial as they give a higher degree of freedom for the cooling of the components.

Figure 2:
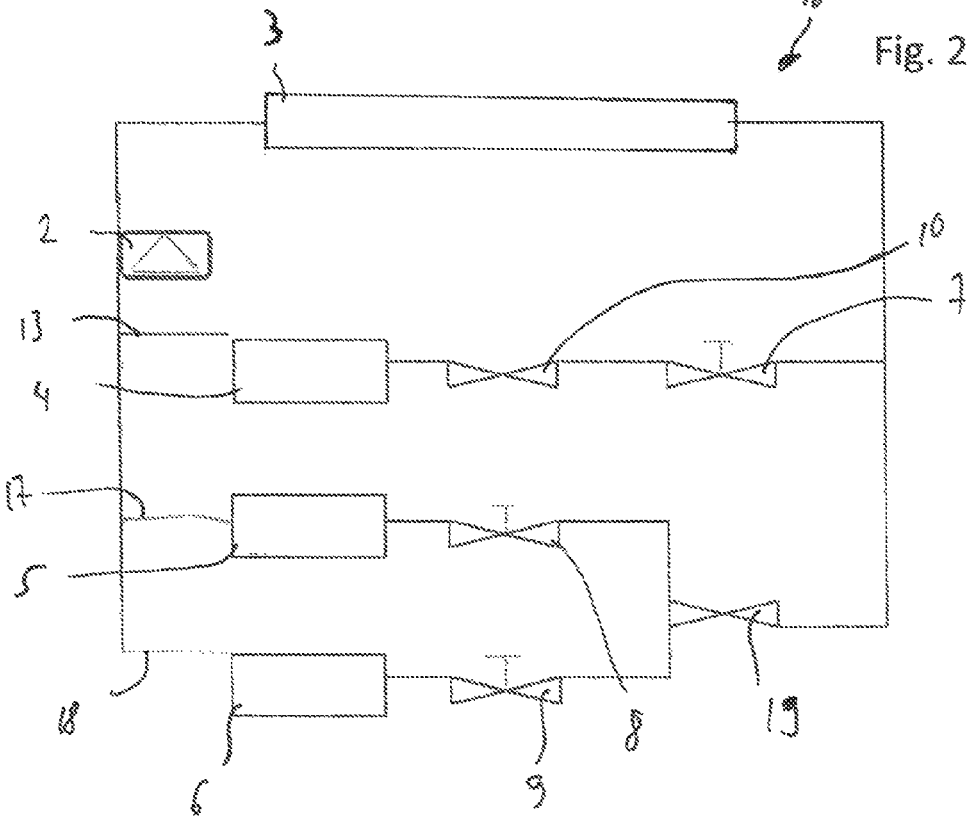
FIG. 2 shows a schematic according to FIG. 1 with the difference that two of the three paths are using the same expansion device, with the cooling circuit therefore comprising only two expansion devices.

FIG. 2 shows a schematic of a second embodiment of a cooling circuit 16. The cooling circuit 16 also comprises a condenser 3 and a compressor 2, which are arranged identical to the cooling circuit 1 of FIG. 1.

Furthermore the cooling circuit 16 comprises three paths 13, 17 and 18 whereas the first path 13 is identical to the path 13 of FIG. 1. The second path 17 comprises an evaporator 5 and a shut-off valve 8. The third path 18 comprises an evaporator 6 and a shut-off valve 9. Different to the cooling circuit 1 of FIG. 1 is that the second path 17 and the third path 18 are fluid combined after the shut-off valves 8 and 9. They use the save expansion device 19.

Another difference is that the order of the elements within the paths 17 and 18 is different to the order in the paths 13, 14 and 15. The paths 17 and 18 show an evaporator 5 and 6 followed by the shut-off valves 8 and 9 followed by the expansion device 19. The paths 13, 14 and 15 show an evaporator 4, 5 and 6, followed by an expansion device 10, 11 and 12, followed by a shut-off valve 7, 8 and 9.

Figure 3:
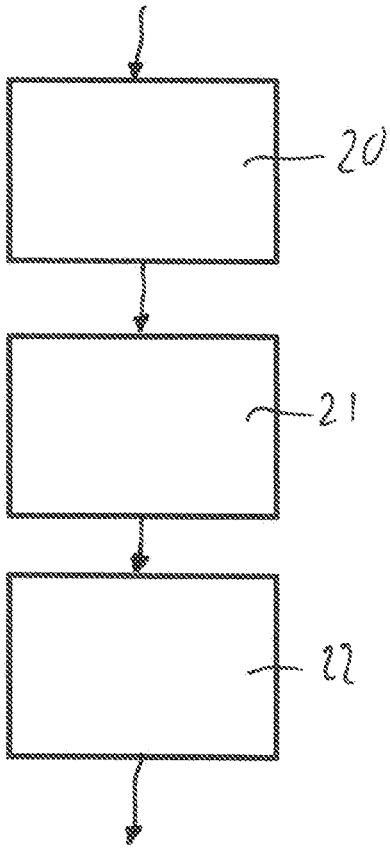
FIG. 3 shows a flow chart of the method used to control the cooling circuit.

FIG. 3 shows a flow chart of the method to control a cooling circuit. Beginning from the top an information, which is gathered from sensors, calculated or measured is put into a processing unit. This is shown in block 20. The information is evaluated and a signal is sent to one or more of the shut-off valves. This is shown in block 21. The reaction of the cooling circuit is again evaluated by gathering information from sensors, by calculation or by measurement. This is shown in block 22. In a further embodiment it is possible to add a feedback-loop to give a feedback to the processing unit about the implications of the signals that have been sent to the shut-off valves.

The result of block 20 can be in the form of the preset routines or alternatively by individually processed commands, which are sent to the shut-off valves.

Furthermore the cooling circuits can be controlled by other relevant methods as well. For instance by start- and stop-signals for the compressor.

While the invention has been shown in FIGS. 1, 2 and 3 in exemplary embodiments, it will be clear to those skilled in the arts to which it pertains that a variety of modifications and changes can be made thereto without departing from the scope of the invention.

What is claimed is:

1. A method to control a cooling circuit, the method comprising:

providing at least three evaporators that are fluid connected to the cooling circuit in a parallel connection in individual paths, with at least two of the individual paths having shut-off valves through which a flow of a refrigerant, which is circulating through the specific path, is metered or cut off; and activating or deactivating the shut-off valves individually, with the individual evaporators being operative when the shut-off valve located within the specific path of the individual evaporator permits fluid flow, wherein a maximum of two of the at least three evaporators are operative simultaneously.

2. The method as claimed in claim 1, wherein the activation and/or deactivation of the shut-off valves is based on a prioritization of cooling needs.

3. The method as claimed in claim 1, wherein the activation and/or deactivation of the shut-off valves is based on preset limits regarding temperature levels and/or preset boundaries regarding temperature gradients.

4. The method as claimed in claim 1, wherein the activation and/or deactivation of the shut-off valves is triggered by one or more preset routines, which are integrated as default values within the control system.

5. The method as claimed in claim 4, wherein a preset routine triggers the activation of a shut-off valve after a predetermined time has elapsed since the last activation.

6. The method as claimed in claim 4, wherein a preset routine triggers the activation of a shut-off valve based on a distribution of a lubricant within the cooling circuit.

7. The method as claimed in claim 4, wherein a preset routine triggers the activation and/or deactivation of a shut-off valve based on a prediction of future cooling loads.

8. The method as claimed in claim 1, wherein the one or more of the evaporators is a storage evaporator, which possesses the capability to store cooling capacity.

9. The method as claimed in claim 1, wherein the cooling circuit comprises one compressor, three evaporators, three shut-off valves, one condenser and one or more expansion devices, wherein each path comprises one expansion device or two or more paths share one expansion device.

10. The method as claimed in claim 1, wherein the cooling circuit is an automobile vehicle cooling circuit, and wherein the shut-off valves are activated and/or deactivated based on information from sensors of the automobile vehicle.

11. The method as claimed in claim 1, wherein the cooling circuit comprises a single compressor.

12. The method as claimed in claim 1, further comprising at least two expansion devices, wherein a respective expansion device is positioned between the evaporator and the shut-off valve in each of the at least two of the individual paths.

13. The method as claimed in claim 1, wherein the cooling circuit comprises a single compressor, three evaporators, three shut-off valves, one condenser and two expansion devices, wherein two paths share one of the expansion devices.

* * * * *